US007600571B2

(12) United States Patent
Smith

(10) Patent No.: US 7,600,571 B2
(45) Date of Patent: Oct. 13, 2009

(54) METHOD AND APPARATUS FOR RE-ENTERING AN ABANDONED WELL

(76) Inventor: Christopher John Smith, 5 Hwy. Mobile Home Pk., Provost, AB (CA) T0B 3S0

( * ) Notice: Subject to any disclaimer, the term of this patent is extended or adjusted under 35 U.S.C. 154(b) by 199 days.

(21) Appl. No.: 11/902,579

(22) Filed: Sep. 24, 2007

(65) Prior Publication Data

US 2008/0289817 A1 Nov. 27, 2008

(30) Foreign Application Priority Data

May 23, 2007 (CA) ..... 2590021

(51) Int. Cl.
*E21B 33/02* (2006.01)

(52) U.S. Cl. ..... 166/379; 166/75.13; 137/371

(58) Field of Classification Search ..... 166/379, 166/102, 95.1, 88.1, 79.1, 76.1, 75.13, 75.11; 137/371

See application file for complete search history.

(56) References Cited

U.S. PATENT DOCUMENTS 4,703,813 A * 11/1987 Sieler ..... 175/5
4,747,453 A * 5/1988 Howard, Sr. ..... 166/379
5,010,957 A * 4/1991 Kenner ..... 166/379
5,107,931 A * 4/1992 Valka et al. ..... 166/342
5,372,198 A * 12/1994 North et al. ..... 166/363
6,817,417 B2 * 11/2004 Blair et al. ..... 166/335

* cited by examiner

*Primary Examiner*—Kenneth Thompson
(74) *Attorney, Agent, or Firm*—Nixon & Vanderhye P.C.

(57) ABSTRACT

A reentry apparatus for installation on an abandoned well with a surface casing and a production casing inside and below the top end of the surface casing. A production plate seals the production casing. The apparatus includes a drill guide tube with a bottom end attachable to the production plate and configured to extend up above the top end of the surface casing. A surface plate seals the top of the surface casing and the tube extends up through the surface plate and is sealed thereto. A vent hole extends through the tube wall between the surface and production plates. A plug blocks the central passage of the tube above the vent hole. The tube is adapted for releasable attachment of a cap and a pressure control apparatus with drilling tool such that the drilling tool can bore through the plug while containing pressurized fluid in the surface casing.

19 Claims, 3 Drawing Sheets

METHOD AND APPARATUS FOR RE-ENTERING AN ABANDONED WELL

This invention is in the field of oil and gas wells and in particular an apparatus for installation when abandoning a well that will safely allow re-entry into the abandoned well, and a method of abandoning and re-entering a well.

BACKGROUND

Oil and gas wells have a finite productive life. Once all economically recoverable product has been removed from the well, the well is abandoned. Typically such abandonment involves cutting off the well casing below the ground surface, sealing the well, and then covering the sealed well with soil, effectively burying the top of the well.

A typical well will have a production casing extending down from the surface to the production zone where oil or gas is present. At the surface the production casing is located inside a surface casing that has a diameter larger than the production casing. The surface casing extends downward from the surface into the ground to protect the upper portion of the production casing.

During abandonment the surface casing will be cut down to a level below ground level, and the production casing will be cut down to a level below the top of the surface casing. A steel production plate will be fitted inside the top of the production casing and welded to the production casing to seal the casing. A surface plate will be fitted inside the top of the surface casing above the production plate and welded in place to seal the surface casing.

It is at times required or desirable to re-enter abandoned wells to inspect same or sometimes to re-work the well when the economics of recovery change, or when new technologies become available that may make it economical to operate the well again. Such re-entry can be hazardous as there is no provision to allow an operator to determine whether pressure has built up inside one or both of the casings, and so the sealing plates must be drilled to determine what is present in the sealed casings. The drilling tool must be housed inside a pressure control apparatus to control any pressurized gases that may be present under the plates. The shank of a drill bit will extend through a packing or like sealing element in the pressure control apparatus such that when the plate is pierced any pressurized gases that may be present are contained. Channels and caps on the pressure control apparatus allow the gases to be directed to a vent or containment vessel.

To re-enter a well it is typically required to weld the pressure control apparatus on to the surface plate. It is generally not possible or practical to determine the extent of any corrosion or like weaknesses that might be present in the casings or sealing plates, and the intense heat of welding may rupture same and cause a fire or other injury.

SUMMARY OF THE INVENTION

It is an object of the present invention to provide a method and apparatus for allowing re-entry into an abandoned oil or gas well that overcomes problems in the prior art.

In a first embodiment the invention provides an abandoned well comprising a surface casing extending upward from a subterranean location, and a production casing extending upward from a subterranean location inside the surface casing and having a top end below the top end of the surface casing. A production plate is attached to a top end of the production casing and seals the top end of production casing. A drill guide tube has a bottom end attached to the production plate and extends up from the production plate to a top end of the drill guide tube located above the top end of the surface casing. A surface plate defines a guide hole and is attached to a top end of the surface casing such that the drill guide tube extends through the guide hole, and the surface plate is sealed to the top end of surface casing and sealed to the drill guide tube. A vent hole extends from a central passage of the drill guide tube through a wall of the drill guide tube below the surface plate and above the production plate, and an internal plug is operative to block the central passage of the drill guide tube at a location above the vent hole and below the top end of the drill guide tube. The top end of the drill guide tube is adapted for releasable attachment of a cap and releasable attachment of a pressure control apparatus and drilling tool such that the drilling tool can bore through the internal plug while containing pressurized fluid in the surface casing.

In a second embodiment the invention provides a reentry apparatus for installation on an abandoned well. The abandoned well comprises a surface casing extending upward from a subterranean location, a production casing extending upward from a subterranean location inside the surface casing and having a top end below the top end of the surface casing, and a production plate attached to a top end of the production casing and sealing the top end of production casing. The reentry apparatus comprises a drill guide tube having a bottom end adapted for attachment to the production plate and configured to extend up from the production plate to a top end of the drill guide tube located above the top end of the surface casing. A surface plate defines a guide hole and is adapted for attachment to a top end of the surface casing such that the drill guide tube extends through the guide hole. The surface plate is adapted to be sealed to the top end of surface casing and sealed to the drill guide tube. A vent hole extends from a central passage of the drill guide tube through a wall of the drill guide tube at a location when installed that is below the surface plate and above the production plate. An internal plug is operative to block the central passage of the drill guide tube at a location above the vent hole and below the top end of the drill guide tube. The top end of the drill guide tube is adapted for releasable attachment of a cap and releasable attachment of a pressure control apparatus and a drilling tool such that the drilling tool can bore through the internal plug while containing pressurized fluid in the surface casing.

In a third embodiment the invention provides method of abandoning and reentering a well. The well comprises a surface casing extending upward from a subterranean location and a production casing extending upward from a subterranean location inside the surface casing and having a top end below a top end of the surface casing. The method comprises welding a production plate to a top end of the production casing to seal the top end of production casing; providing a drill guide tube defining a central passage and welding a bottom end of the drill guide tube to the production plate such that the drill guide tube extends up from the production plate to a top end of the drill guide tube located above a top end of the surface casing; providing a surface plate defining a guide hole and placing the surface plate on the top end of the surface casing such that the drill guide tube extends through the guide hole; welding the surface plate to the top end of surface casing and to the drill guide tube to seal the surface casing; providing a vent hole extending from the central passage thereof through a wall of the drill guide tube at a location that is below the surface plate and above the production plate, and providing an internal plug operative to block the central passage of the drill guide tube at a location above the vent hole and below the top end of the drill guide tube, threading a cap onto the top end of the drill guide tube to abandon the well; reentering the well by removing the cap and threading a pressure control apparatus and a drilling tool onto the top end of the drill guide tube; boring through the internal plug with the drilling tool; containing pressurized fluid in the surface casing with the pressure control apparatus; releasing pressurized fluid from the surface casing; boring through the production plate with the drilling tool; containing pressurized fluid in the production casing with the pressure control apparatus; releasing pressurized fluid from the production casing.

Thus when it is desired to re-enter a well abandoned according to the present invention, the cap is removed from the top end of the tube, and the pressure control apparatus is secured to the threads in the tube with a drilling tool installed. The internal plug is drilled out such that gases from the surface casing can pass through the vent and up the central passage of the tube through the plug to the top end of the tube to be directed as desired. Once any pressure in the surface casing has been bled off, the drill is pushed through to the bottom of the tube and the production plate is drilled out, and any pressurized gases in the production casing can then pass up the central channel to the top end of the tube to be directed as desired.

Thus any pressurized gases in the well can be bled off, and the nature of the gases can be determined without any welding. All required welding takes place during the initial well abandonment when the condition of the casings is readily visible, and before corrosion and the like can affect the casings.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
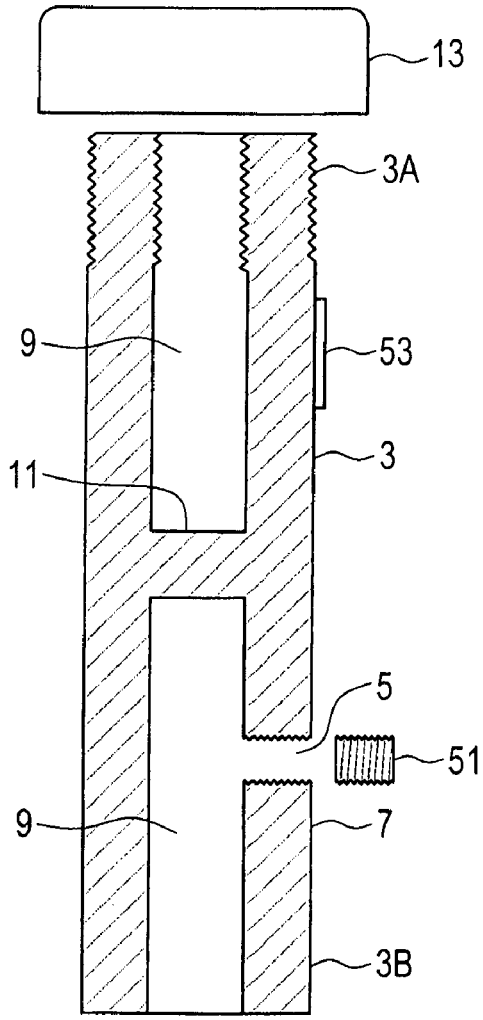
FIG. 1 is a schematic sectional side view of the drill guide tube of an embodiment of the present invention.
Figure 2:
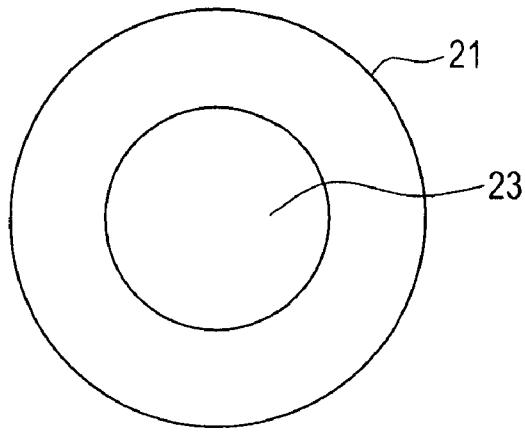
FIG. 2 is a top view of the surface plate for use with the embodiment of FIG. 1.
Figure 3:
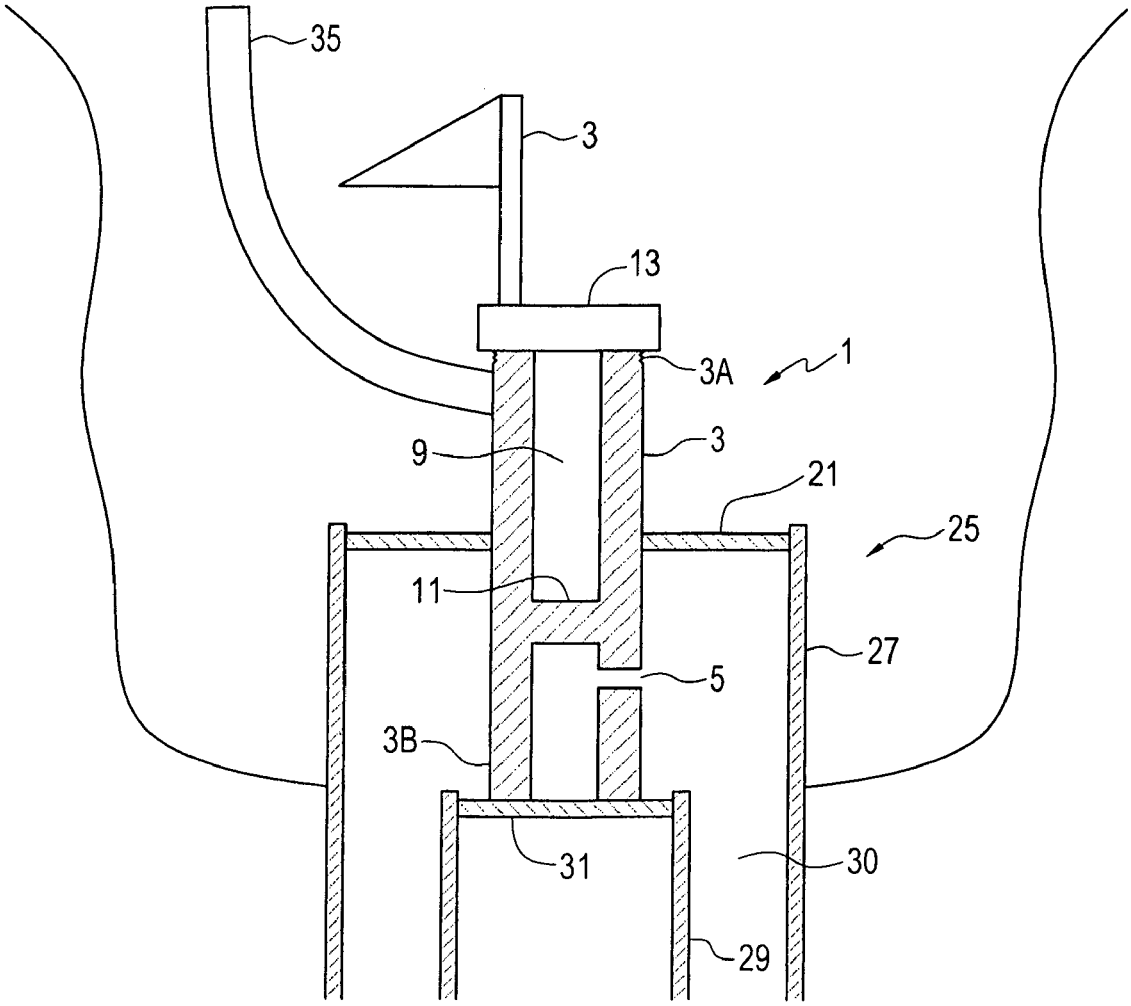
FIG. 3 is a schematic sectional side view of the apparatus of FIGS. 1 and 2 installed in an abandoned well.

FIGS. 1-3 illustrate the operation of an embodiment of the well reentry apparatus 1 of present invention. The apparatus 1 comprises, as seen in FIG. 1, a drill guide tube 3 with a top end 3A and a bottom end 3B. At a middle portion of the tube 3 a vent hole extends through the wall 7 of the tube to the central passage 9 of the tube 3. An internal plug 11 is located in the central passage 9 of the tube 3 to block the central passage 9 above the vent hole 5 and below the top end 3A of the tube 3. The top end 3A of the tube 3 is threaded or otherwise configured such that a pressure control apparatus can be secured to the top end 3A of the tube 3 without welding. A threaded cap 13 is threaded onto the top end 3A of the tube 3 to keep to prevent water, soil, and the like from entering the central passage 9 of the tube 3 and to protect the threads 12 on the top end 3A of the tube 3. The threads 12 can be inside the central passage 9 or on the outside of the tube 3, or both. Typically the cap 13 will be greased to prevent it from corroding onto the threads of the tube 3 and to facilitate removal if and when re-entry is desired.

The tube 3 has a relatively thick wall 7 to reduce the risk that corrosion or the like might cause leak through the wall 7. Similarly the internal plug 11 is relatively thick as well, with a thickness about the same as that of the casing wall. The drill guide tube 3 will typically be machined from a steel cylinder to provide the required wall thickness as well as the threads, central passage, plug, and the like.

The apparatus 1 further comprises a surface plate 21 as illustrated in FIG. 2 for sealing the surface casing of an abandoned well. In the illustrated embodiment the surface plate 21 conveniently has an outside diameter selected to fit snugly inside the surface casing such that same can be welded to the surface casing to seal the surface casing. The surface plate 21 also defines a guide hole 23 in the middle thereof with a diameter selected such that the drill guide tube 3 can slide through the guide hole 23 and then be welded to the surface plate 21 to complete sealing of the surface casing as described below.

FIG. 3 illustrates the well re-entry apparatus 1 installed in an abandoned well 25 comprising a surface casing 27 and a production casing 29. The soil at the top of the well 25 has been excavated and the surface casing 27 and production casing 29 have been cut off below ground level, with the top of the production casing 29 below the top of the surface casing 27. A production plate 31 has been welded into the production casing 29 to seal the production casing 29.

The bottom end 3B of the drill guide tube 3 is then tack welded to the top surface of the production plate 31. The surface plate 21 is moved down over the tube 3 so the tube 3 slides up through the guide hole 23. The fit of the surface plate 21 in the surface casing 27 is checked and any adjustments are made. The surface casing 27 is then removed. The bottom end 3B of the tube 3 is welded to the production plate 31, and the surface plate 21 is moved down over the tube 3 again and welded to the surface casing 27 and to the drill guide tube 3.

When installed as illustrated the vent hole 5 is located below the surface plate 21 and above the production plate 31 such that gases from the well annulus 30 between the outside of the production casing 29 and the inside of the surface casing 27 can enter the central passage 9 of the tube 3.

The cap 13 is greased and installed on the threaded top end 3A of the tube 3 to seal the tube 3 an protect the threaded end. A flag stick 33, marker ribbon 35, or like aid to locating the well may be conveniently attached to the upper portion of the tube 3 extending above the surface plate 21. Excavated soil can now be moved back to cover the abandoned well.

It is to be noted that with the configuration of the apparatus 1 the well is sealed by solid welded members, and failure of the threaded cap 13 will not release any gases from the well.

Figure 4:
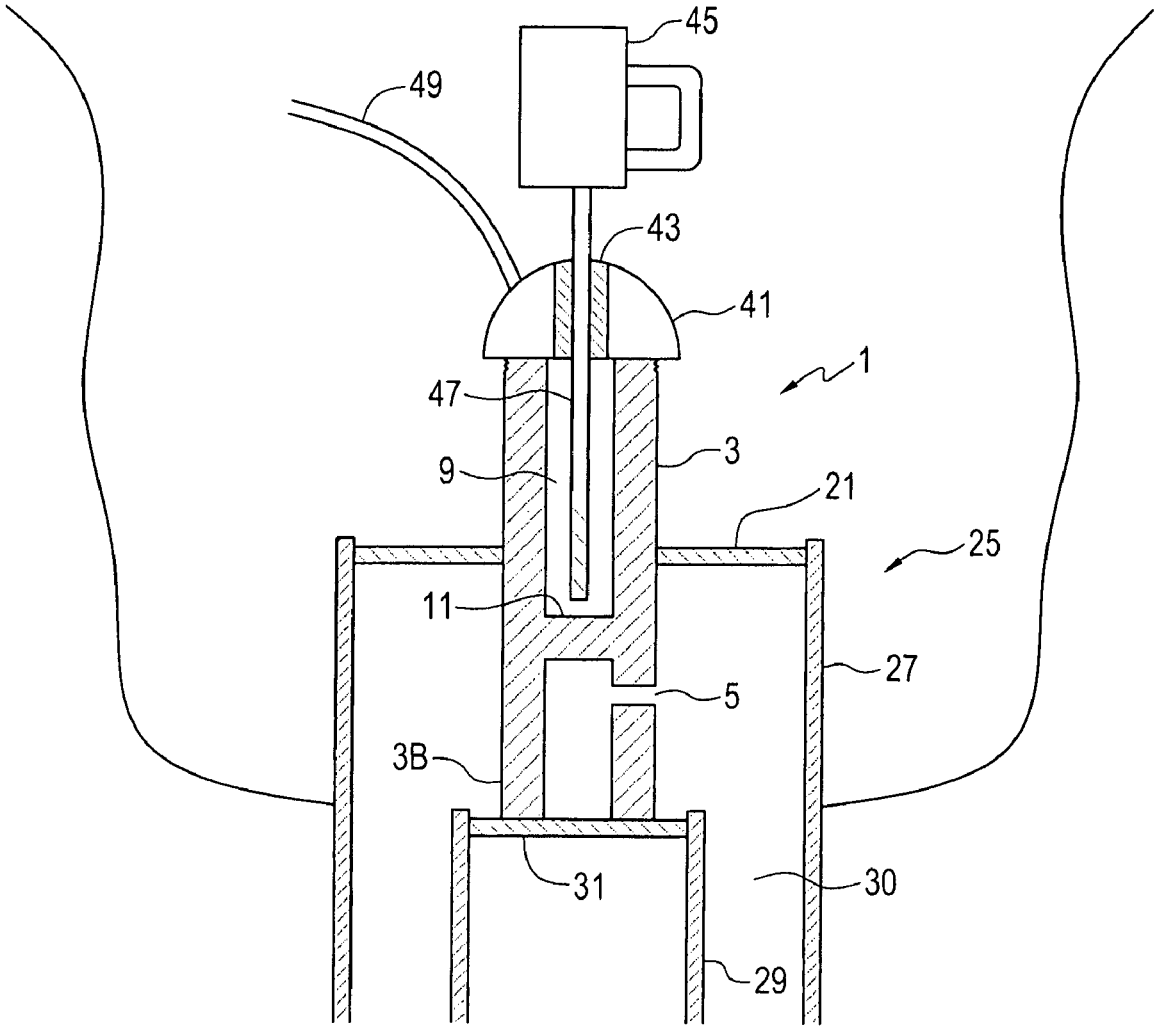
FIG. 4 is a schematic sectional side view of a pressure control apparatus and drill set up to re-enter the abandoned well on which the apparatus of FIG. 3 is installed.

To re-enter the abandoned well 25 at a later date the cap 13 is removed from the top end 3A of the tube 3 and a pressure control apparatus 41, as illustrated in FIG. 4, comprising packing seals 43 or the like and with a drilling tool 45 installed, is secured to the threaded top end 3A of the tube. Such pressure control apparatuses configured to seal a drill bit shank are known in the art for controlling pressure that might be released when drilling through a plate or the like.

The internal plug 11 is drilled out with the drill bit 47 such that gases from the well annulus 30 between the outside of the production casing 29 and the inside of the surface casing 27 can pass through the vent hole 5 and up the central passage 9 through the drilled out internal plug 11 to the top end 3A of the tube 3 to be directed through conduits 49 connected to the pressure control apparatus 41 as desired.

Once any pressure in the annulus 30 has been bled off, the drill bit 47 is pushed through to the bottom end 3B of the tube 3 and the production plate 31 is drilled out, and any pressurized gases in the production casing 29 can then pass up the central channel 9 to the top end 3A of the tube 3 to the pressure control apparatus 41 to be directed as desired. Any pressurized fluid in the production casing 29 will also pass through the vent hole 5 and fill and pressurize the annulus 30 and be contained therein. If it is desired that gases from the production casing be contained within the tube 3 instead, a vent plug 51, as illustrated in FIG. 1, can be inserted into the vent hole 5 to block the vent hole 5. This requires that the surface plate 21 and/or surface casing 27 be cut away sufficiently to allow the vent plug 51 to be inserted. A vent location mark 53, as illustrated in FIG. 1, on the side of the tube 3 directly above and aligned with the vent hole 5 will allow workers to cut away the surface plate 21 and/or casing 27 in the correct location to insert the plug 5, which may conveniently be threaded for secure insertion. The mark 53 could be a raised protrusion as illustrated, or a groove, or like mark.

Once the plug is inserted, when the production plate 31 is drilled through pressurized gases in the production casing will be contained in the tube 3 and directed through the pressure control apparatus 41 as described above.

The present invention thus allows any pressurized gases in the well to be bled off, and the nature of the gases determined without any welding in the vicinity of the well.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. An abandoned well comprising:

a surface casing extending upward from a subterranean location;

a production casing extending upward from a subterranean location inside the surface casing and having a top end below the top end of the surface casing;

a production plate attached to a top end of the production casing and sealing the top end of production casing;

a drill guide tube having a bottom end attached to the production plate and extending up from the production plate to a top end of the drill guide tube located above the top end of the surface casing;

a surface plate defining a guide hole and attached to a top end of the surface casing such that the drill guide tube extends through the guide hole, and wherein the surface plate is sealed to the top end of surface casing and sealed to the drill guide tube;

a vent hole extending from a central passage of the drill guide tube through a wall of the drill guide tube below the surface plate and above the production plate;

an internal plug operative to block the central passage of the drill guide tube at a location above the vent hole and below the top end of the drill guide tube;

wherein the top end of the drill guide tube is adapted for releasable attachment of a cap and releasable attachment of a pressure control apparatus and drilling tool such that the drilling tool can bore through the internal plug while containing pressurized fluid in the surface casing.

2. The well of claim 1 further comprising a marker device attached to the top of the drill guide tube to facilitate locating the abandoned well when covered with earth.

3. The well of claim 1 wherein the production plate is attached to the top end of the production casing by welding to seal the top end of production casing.

4. The well of claim 1 wherein the surface plate is attached to a top end of the surface casing by welding to seal the surface plate to the top end of surface casing, and the surface plate is welded to the drill guide tube to seal the surface plate to the drill guide tube.

5. The well of claim 1 wherein the top end of the drill guide tube is threaded for attachment of the cap and the drilling tool and pressure control apparatus.

6. The well of claim 1 further comprising a vent plug adapted to be inserted into the vent hole to block the vent hole.

7. The well of claim 6 further comprising a vent location mark on an upper portion of the tube directly above the vent hole.

8. A reentry apparatus for installation on an abandoned well, the abandoned well comprising a surface casing extending upward from a subterranean location, a production casing extending upward from a subterranean location inside the surface casing and having a top end below the top end of the surface casing, and a production plate attached to a top end of the production casing and sealing the top end of production casing, the reentry apparatus comprising:

a drill guide tube having a bottom end adapted for attachment to the production plate and configured to extend up from the production plate to a top end of the drill guide tube located above the top end of the surface casing;

a surface plate defining a guide hole and adapted for attachment to a top end of the surface casing such that the drill guide tube extends through the guide hole, and wherein the surface plate is adapted to be sealed to the top end of surface casing and sealed to the drill guide tube;

a vent hole extending from a central passage of the drill guide tube through a wall of the drill guide tube at a location when installed that is below the surface plate and above the production plate;

an internal plug operative to block the central passage of the drill guide tube at a location above the vent hole and below the top end of the drill guide tube;

wherein the top end of the drill guide tube is adapted for releasable attachment of a cap and releasable attachment of a pressure control apparatus and a drilling tool such that the drilling tool can bore through the internal plug while containing pressurized fluid in the surface casing.

9. The apparatus of claim 8 further comprising a marker device attached to the top of the drill guide tube to facilitate locating the abandoned well when covered with earth.

10. The apparatus of claim 8 wherein the production plate is adapted to be attached to the top end of the production casing by welding to seal the top end of production casing.

11. The apparatus of claim 8 wherein the surface plate is adapted to be attached to a top end of the surface casing by welding to seal the surface plate to the top end of surface casing, and the surface plate is adapted to be welded to the drill guide tube to seal the surface plate to the drill guide tube.

12. The apparatus of claim 8 wherein the top end of the drill guide tube is threaded for attachment of the drilling tool and pressure control apparatus.

13. The apparatus of claim 8 further comprising a vent plug adapted to be inserted into the vent hole to block the vent hole.

14. The apparatus of claim 13 further comprising a vent location mark on an upper portion of the tube directly above the vent hole.

15. A method of abandoning and reentering a well, the well comprising a surface casing extending upward from a subterranean location and a production casing extending upward from a subterranean location inside the surface casing and having a top end below a top end of the surface casing, the method comprising:

welding a production plate to a top end of the production casing to seal the top end of production casing;

providing a drill guide tube defining a central passage and welding a bottom end of the drill guide tube to the production plate such that the drill guide tube extends up from the production plate to a top end of the drill guide tube located above a top end of the surface casing;

providing a surface plate defining a guide hole and placing the surface plate on the top end of the surface casing such that the drill guide tube extends through the guide hole;

welding the surface plate to the top end of surface casing and to the drill guide tube to seal the surface casing;

providing a vent hole extending from the central passage thereof through a wall of the drill guide tube at a location that is below the surface plate and above the production plate, and providing an internal plug operative to block the central passage of the drill guide tube at a location above the vent hole and below the top end of the drill guide tube;

threading a cap onto the top end of the drill guide tube to abandon the well;

reentering the well by removing the cap and threading a pressure control apparatus and a drilling tool onto the top end of the drill guide tube;

boring through the internal plug with the drilling tool;

containing pressurized fluid in the surface casing with the pressure control apparatus;

releasing pressurized fluid from the surface casing;

boring through the production plate with the drilling tool;

containing pressurized fluid in the production casing with the pressure control apparatus;

releasing pressurized fluid from the production casing.

16. The method of claim 15 comprising covering the surface casing and drill guide tube with earth after threading the cap onto the top end of the drill guide tube, and removing the earth to expose the surface casing and drill guide tube prior to removing the cap.

17. The method of claim 16 comprising attaching a marker device to the top of the drill guide tube prior to covering the surface casing and drill guide tube with earth.

18. The method of claim 15 comprising, after releasing pressurized fluid from the surface casing, cutting away a portion of the surface plate or surface casing as required to expose the vent hole, and inserting a vent plug into the vent hole to block the vent hole.

19. The method of claim 18 comprising providing a vent location mark on an upper portion of the tube directly above the vent hole to facilitate exposing the vent hole.

* * * * *